US010040289B2

(12) United States Patent
Arakane

(10) Patent No.: US 10,040,289 B2
(45) Date of Patent: Aug. 7, 2018

(54) INK-JET PRINTER

(71) Applicant: BROTHER KOGYO KABUSHIKI KAISHA, Nagoya-shi, Aichi-ken (JP)

(72) Inventor: Satoru Arakane, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/470,392

(22) Filed: Mar. 27, 2017

(65) Prior Publication Data

US 2017/0297338 A1 Oct. 19, 2017

(30) Foreign Application Priority Data

Apr. 18, 2016 (JP) ..... 2016-082661

(51) Int. Cl.
*B41J 2/045* (2006.01)
*B41J 2/165* (2006.01)
*B41J 23/00* (2006.01)

(52) U.S. Cl.
CPC ..... *B41J 2/16511* (2013.01); *B41J 2/04508* (2013.01); *B41J 2/04586* (2013.01); *B41J 23/00* (2013.01)

(58) Field of Classification Search
CPC ..... B41J 2/16511; B41J 2/04508; B41J 2/04586; B41J 23/00; B41J 2/1707; B41J 2/085; B41J 2/17566; B41J 2/4155; B41J 11/007; B41J 2002/061; B41J 2002/16597; B41J 2002/063
See application file for complete search history.

(56) References Cited

U.S. PATENT DOCUMENTS 5,896,144 A * 4/1999 Kishimoto ..... B41J 2/16547 347/30
5,953,024 A * 9/1999 Lee ..... B41J 19/205 347/23
2006/0024109 A1 2/2006 Morikawa et al.
2017/0297341 A1* 10/2017 Arakane ..... B41J 2/1707
2018/0004462 A1* 1/2018 Arakane ..... B41J 2/1652

FOREIGN PATENT DOCUMENTS

JP 2003-312080 A 11/2003
JP 2004-276407 A 10/2004
JP 2006-35650 A 2/2006
JP 2014-019004 A 2/2014

* cited by examiner

*Primary Examiner* — Julian Huffman
*Assistant Examiner* — Michael Konczal
(74) *Attorney, Agent, or Firm* — Merchant & Gould P.C.

(57) ABSTRACT

There is provided an ink-jet printer, including: a conveyor; a carriage; a recording head; a sensor; a cap; a cap shifter; a reference wall; a memory; a power supply; a command receiver; and a controller. The controller is configured to execute judging a state of the power supply section; changing a relative position of the recording head and the cap from the covering position to the separated position to take the cap off the recording head; switching the power supply from the sleep state to the drive state, changing a relative position of the recording head and the cap from the covering position to the separated position by taking the cap off the recording head, storing in the memory the position information, and recording an image on the sheet conveyed to the sheet facing area.

14 Claims, 10 Drawing Sheets

INK-JET PRINTER

CROSS REFERENCE TO RELATED APPLICATION

The present application claims priority from Japanese Patent Application No. 2016-082661, filed on Apr. 18, 2016, the disclosure of which is incorporated herein by reference in its entirety.

BACKGROUND

Field of the Invention

The present invention relates to an ink-jet printer that records an image on a sheet, based on a recording command received from an information processing apparatus via a communication network.

Description of the Related Art

In the past, attempts have been made to reduce FPOT (abbreviation of First Print Out Time) in an information processing apparatus and printer connected via a communication network. FPOT is a time from a print instruction being input to the external apparatus to a first sheet being discharged from the printer. Reducing a time of a preparation process is conceivable as one of methods for reducing FPOT. The preparation process is a process that should be executed by the printer before recording an image on the sheet.

As an example of a preparation process, there is known a process in which, when returning from a sleep state, a position of a carriage that has been abutted on a right wall surface is stored as an origin position. As another example of a preparation process, there is known a process in which a cap covering a nozzle surface of a recording head is separated from a carriage. Moreover, movement of the cap is desirably performed with the carriage fixed in a certain position, by the likes of the carriage being abutted on the right wall surface, for example.

SUMMARY

However, when a plurality of preparation processes of the previously mentioned kind are executed in order, common processes are sometimes executed repeatedly. In that case, there is a problem that it takes a long time until all of the preparation processes finish, and as a result, FPOT deteriorates. Moreover, after returning from the sleep state, an additional preparation process such as detection of the previously mentioned origin position must be executed, hence the previously mentioned problem becomes particularly noticeable.

The present teaching was made in view of the above-described circumstances, and has an object of providing an ink-jet printer in which FPOT is improved by efficiently executing the preparation process.

According to an aspect of the present teaching, there is provided an ink-jet printer, including:

a conveyor configured to convey a sheet in a conveyance direction;

a carriage being movable in a main scanning direction along a sheet facing area, the main scanning direction intersecting the conveyance direction, and the sheet facing area facing the sheet conveyed by the conveyor;

a recording head mounted on the carriage to discharge ink from a nozzle;

a sensor detecting a movement amount of the carriage to output a detection signal;

a cap facing the recording head in a case that the carriage is positioned in a first position displaced in the main scanning direction from the sheet facing area, a cap shifter configured to move the cap relative to the recording head, between a covering position closely contacting the recording head to cover the nozzle and a separated position separated from the recording head;

a reference wall restricting movement of the carriage in a direction separating away from the sheet facing area, in a case that the carriage is positioned at a position more separated from the sheet facing area than the first position;

a memory storing position information indicating a position of the carriage based on the detection signal output from the sensor;

a power supply being switchable between a drive state of supplying electric power to the memory and a sleep state of not supplying electric power to the memory;

a command receiver; and a controller configured to control the conveyor, the carriage, the recording head, the sensor, the cap shifter, the memory, and the power supply to execute:

judging a state of the power supply section, under a condition that the command receiver receives a command instructing an operation of the carriage;

in a state where the carriage has been abutted on the reference wall, changing a relative position of the recording head and the cap from the covering position to the separated position to take the cap off the recording head, under a condition that the controller has judged that the state of the power supply is the drive state;

switching the power supply from the sleep state to the drive state, under a condition that the controller has judged that the state of the power supply is the sleep state, changing a relative position of the recording head and the cap from the covering position to the separated position to take the cap off the recording head, under a condition that the carriage has been abutted on the reference wall;

storing in the memory the position information indicating a position of the carriage that has abutted on the reference wall; and recording an image on the sheet conveyed to the sheet facing area by the conveyor while moving the carriage in the main scanning direction to a position specified by the position information and the detection signal, under a condition that the cap has been taken off based on having judged that the state of the power supply is the drive state or the cap has been taken off based on having judged that the state of the power supply is the sleep state.

Due to the above-described configuration, in an uncapping process performed based on it having been judged that a state of the power supply section is the sleep state, a preparation process in which a cap is moved, relatively, to a separated position and a preparation process in which position information of a carriage is stored in a memory, are executed in a state where the carriage has been abutted on a reference wall. As a result, a plurality of preparation processes can be more efficiently executed compared to when the process of the carriage being abutted on the reference wall is individually executed in each of the preparation processes. In addition, there does not occur a large difference in processing time between an uncapping process performed based on it having been judged that the state of the power supply section is the drive state and an uncapping process performed based on it having been judged that the state of the power supply section is the sleep state. Therefore, it can be suppressed that FPOT when the command has been received in the sleep state deteriorates more greatly compared to FPOT when the command has been received in the drive state.

Due to the present teaching, a plurality of preparation processes can be more efficiently executed compared to when a process of a carriage being abutted on a reference wall is individually executed in each of the preparation processes.

DESCRIPTION OF THE EMBODIMENTS

Figure 1:
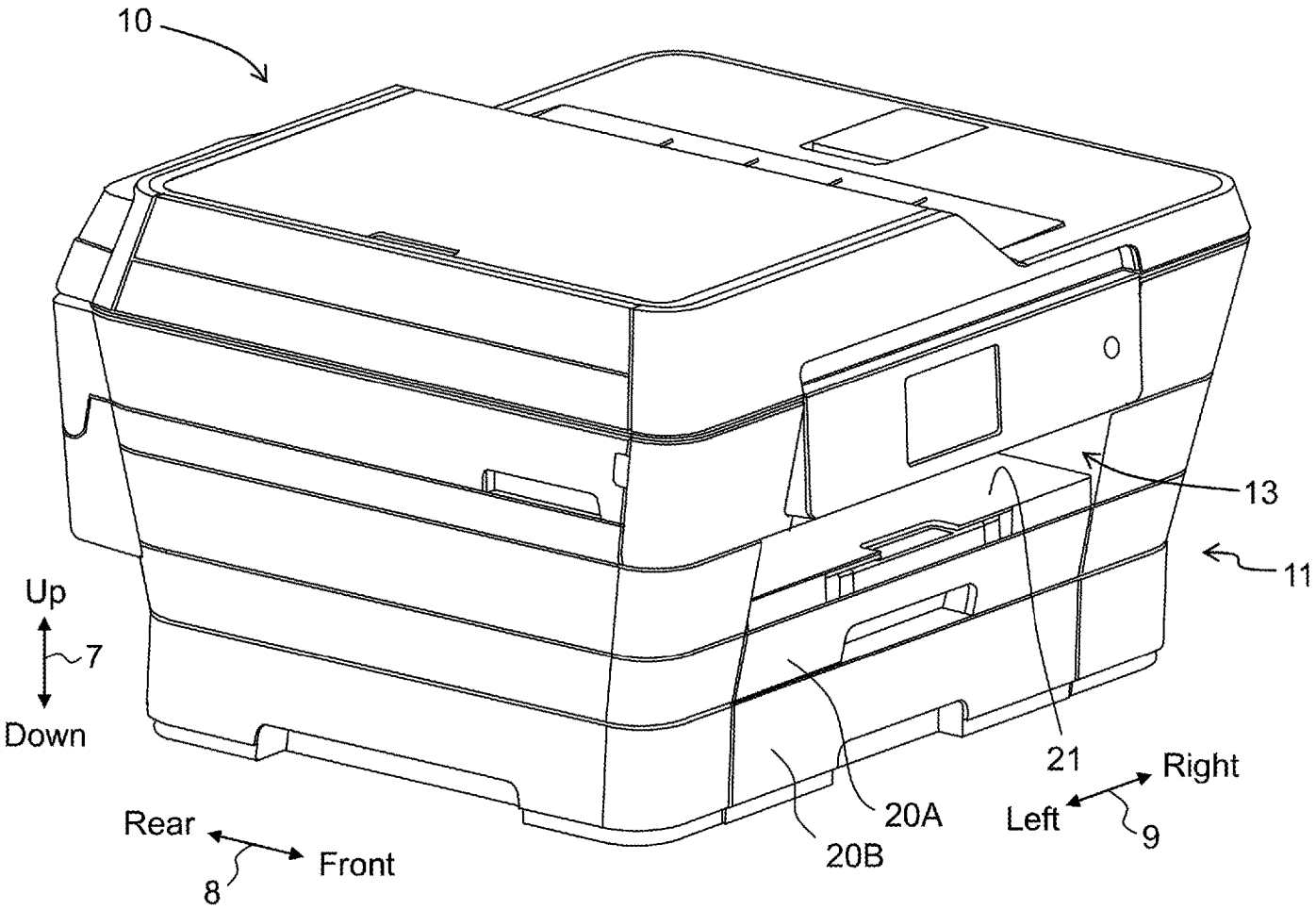
FIG. 1 depicts a perspective view of external appearance of a multifunction peripheral 10.

An embodiment of the present teaching will be described below. Note that the embodiment described below is merely an example of the present teaching, and it goes without saying that the embodiment of the present teaching may be appropriately changed in a range that does not alter the gist of the present teaching. An up-down direction 7 is defined with reference to a state in which a multifunction peripheral 10 is usably disposed (state of FIG. 1), a front-rear direction 8 is defined assuming a side provided with an opening 13 to be a near side (front surface), and a left-right direction 9 is defined viewing the multifunction peripheral 10 from the near side (front surface).

[Overall Configuration of Multifunction Peripheral 10]

As depicted in FIG. 1, the multifunction peripheral 10 is roughly formed into a rectangular parallelepiped. The multifunction peripheral 10 includes a printer 11. The multifunction peripheral 10 is an example of an ink-jet printer. Moreover, the multifunction peripheral 10 may further include a scanner that reads a manuscript to generate image data. Furthermore, the multifunction peripheral 10 may be capable of executing a copy operation in which an image depicted by the image data generated by the scanner is recorded on a sheet 12 by the printer 11.

[Printer 11]

Figure 2:
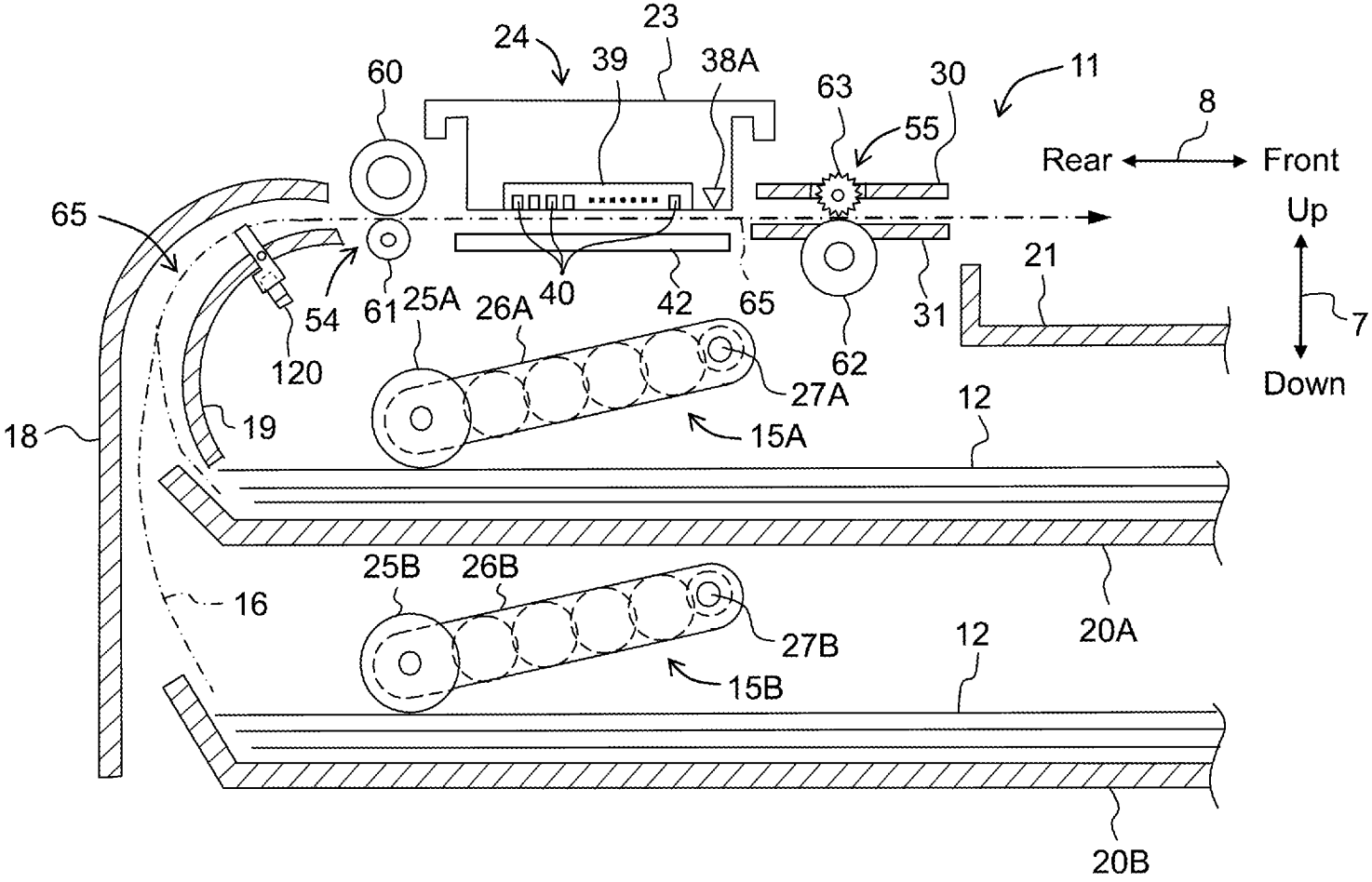
FIG. 2 depicts a longitudinal cross-sectional view showing schematically an internal structure of a printer 11.

The printer 11 discharges ink, thereby recording on the sheet 12 (refer to FIG. 2) the image depicted by the image data. That is, the printer 11 adopts a so-called ink-jet recording system. As depicted in FIG. 2, the printer 11 includes feeders 15A, 15B, feed trays 20A, 20B, a discharge tray 21, a conveyance roller part 54, a recording section 24, a discharge roller part 55, and a platen 42. The conveyance roller part 54 and the discharge roller part 55 are examples of a conveyor.

[Feed Trays 20A, 20B and Discharge Tray 21]

The opening 13 (refer to FIG. 1) is formed in a front surface of the printer 11. The feed trays 20A, 20B are inserted and removed in the front-rear direction 8 via the opening 13. The feed trays 20A, 20B each support a stacked plurality of the sheets 12. The discharge tray 21 supports the sheet 12 discharged by the discharge roller part 55 via the opening 13.

[Feeders 15A, 15B]

As depicted in FIG. 2, the feeder 15A includes a feed roller 25A, a feed arm 26A, and a shaft 27A. The feed roller 25A is rotatably supported by a distal end of the feed arm 26A. The feed arm 26A is pivotably supported by the shaft 27A which is supported by a frame of the printer 11. The feed arm 26A is pivotally biased toward the feed tray 20A by an elastic force due to its own weight or a spring. The feeder 15B includes a feed roller 25B, a feed arm 26B, and a shaft 27B. A specific configuration of the feeder 15B is common to that of the feeder 15A. As a result of the feed roller 25A rotating by a forward rotational drive force of a feed motor 101 (refer to FIG. 6) being transmitted to the feed roller 25A, the feeder 15A feeds to a conveyance path 65 the sheet 12 supported by the feed tray 20A. As a result of the feed roller 25B rotating by the forward rotational drive force of the feed motor 101 being transmitted to the feed roller 25B, the feeder 15B feeds to the conveyance path 65 the sheet 12 supported by the feed tray 20B.

[Conveyance Path 65]

The conveyance path 65 indicates a space formed by guide members 18, 30 and guide members 19, 31. The guide members 18, 30 and the guide members 19, 31 face each other with a certain spacing between them on the inside of the printer 11. The conveyance path 65 is a path that extends from a rear end section of the feed trays 20A, 20B to a rear side of the printer 11. Moreover, the conveyance path 65 is a path that makes a U-turn while extending from a downward side to an upward side at the rear side of the printer 11, and that passes through the recording section 24 to reach the discharge tray 21. Note that a conveyance direction 16 of the sheet 12 in the conveyance path 65 is indicated by a dot-chain line arrow in FIG. 2.

[Conveyance Roller Part 54]

The conveyance roller part 54 is disposed upstream in the conveyance direction 16 of the recording section 24. The conveyance roller part 54 includes a conveyance roller 60 and a pinch roller 61 that face each other. The conveyance roller 60 is driven by a conveyance motor 102 (refer to FIG. 6). The pinch roller 61 rotates in company with rotation of the conveyance roller 60. The sheet 12 is nipped by the conveyance roller 60 that forwardly rotates by a forward rotational drive force of the conveyance motor 102 being transmitted thereto, and the pinch roller 61, whereby the sheet 12 is conveyed along the conveyance direction 16. Moreover, the conveyance roller 60 reversely rotates in a reverse orientation to forward rotation, by a reverse rotational drive force of the conveyance motor 102 being transmitted thereto.

[Discharge Roller Part 55]

The discharge roller part 55 is disposed downstream in the conveyance direction 16 of the recording section 24. The discharge roller part 55 includes a discharge roller 62 and a spur wheel 63 that face each other. The discharge roller 62 is driven by the conveyance motor 102. The spur wheel 63 rotates in company with rotation of the discharge roller 62. The sheet 12 is nipped by the discharge roller 62 that forwardly rotates by a forward rotational drive force of the conveyance motor 102 being transmitted thereto, and the spur wheel 63, whereby the sheet 12 is conveyed along the conveyance direction 16.

[Resist Sensor 120]

As depicted in FIG. 2, the printer 11 includes a resist sensor 120. The resist sensor 120 is arranged upstream in the conveyance direction 16 of the conveyance roller part 54. The resist sensor 120 outputs different detection signals depending on whether the sheet 12 exists at an arrangement position of the resist sensor 120 or not. The resist sensor 120 outputs a high level signal to a later-mentioned controller 130 (refer to FIG. 6), based on the sheet 12 existing at the arrangement position. On the other hand, the resist sensor 120 outputs a low level signal to the controller 130, based on the sheet 12 not existing at the arrangement position.

[Rotary Encoder 121]

Figure 6:
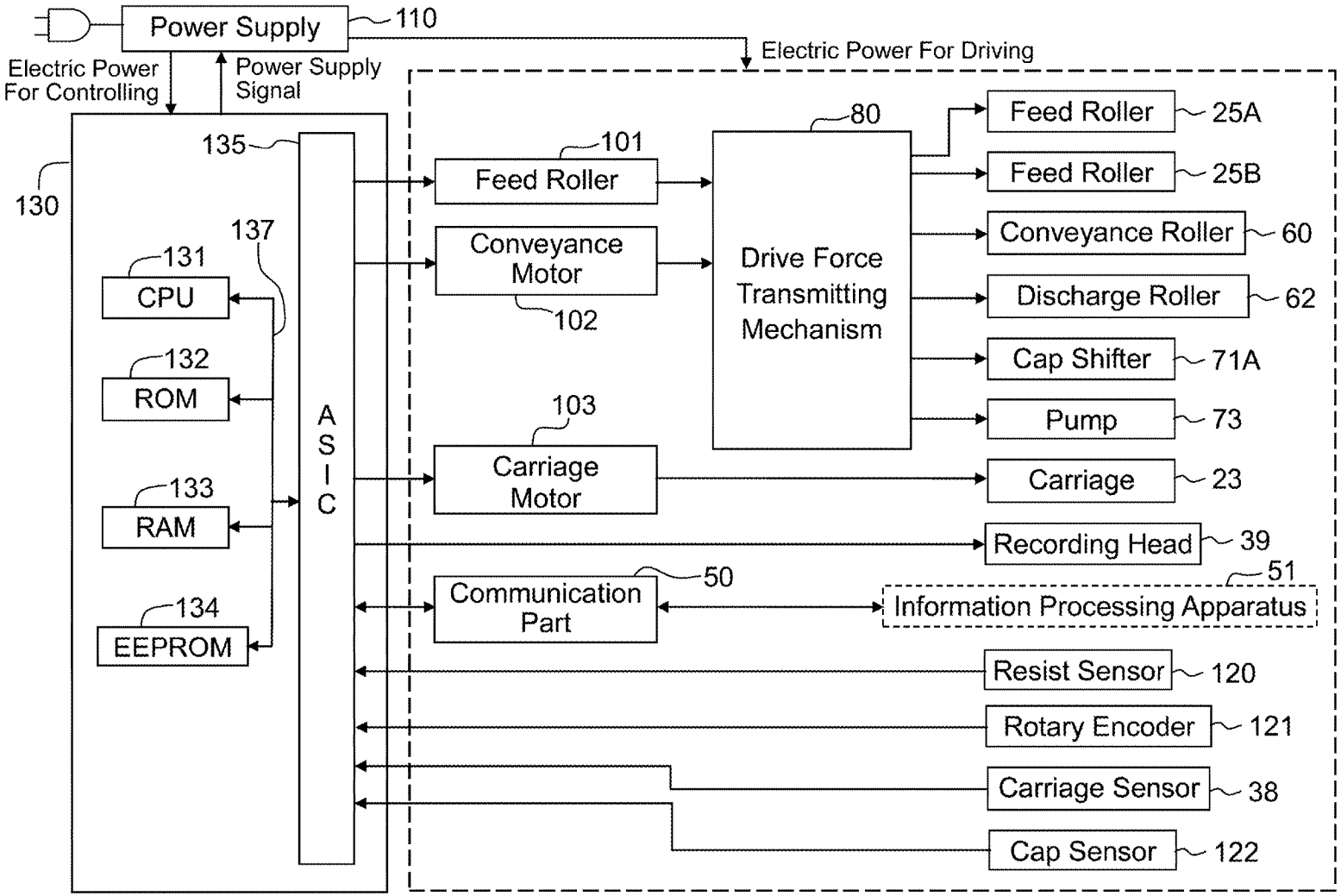
FIG. 6 depicts a block diagram of the multifunction peripheral 10.

As depicted in FIG. 6, the printer 11 includes a rotary encoder 121 that generates a pulse signal based on rotation of the conveyance roller 60 (in other words, rotational drive of the conveyance motor 102). The rotary encoder 121 includes an encoder disk and an optical sensor. The encoder disk rotates along with rotation of the conveyance roller 60. The optical sensor reads the rotating encoder disk to generate a pulse signal and outputs the generated pulse signal to the controller 130.

[Recording Section 24]

Figure 3:
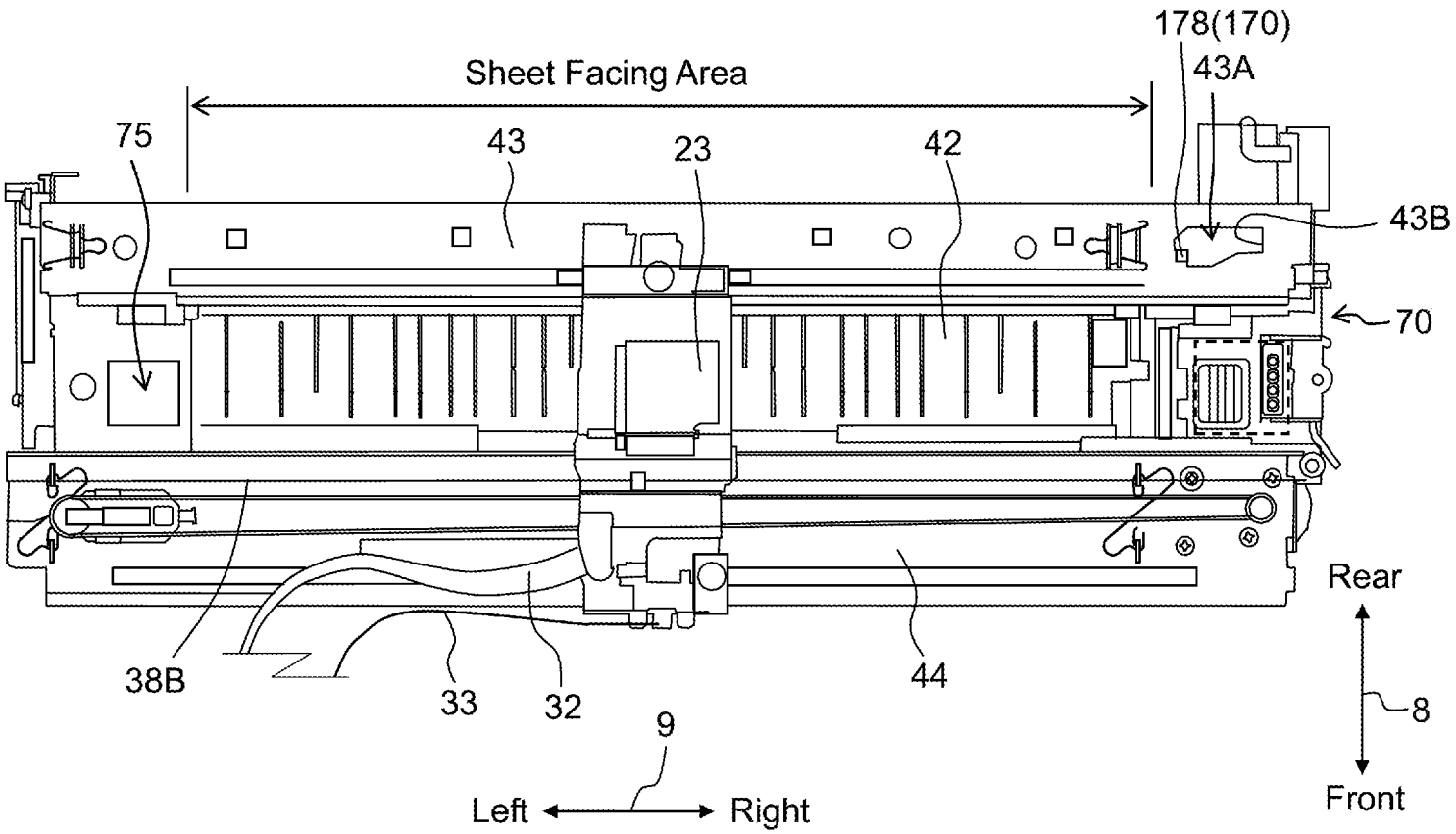
FIG. 3 depicts a plan view of a carriage 23 and guide rails 43, 44.

As depicted in FIG. 2, the recording section 24 is disposed between the conveyance roller part 54 and the discharge roller part 55 in the conveyance direction 16. Moreover, the recording section 24 is disposed facing the platen 42 in the up-down direction 7. The recording section 24 includes a carriage 23, a recording head 39, and an encoder sensor 38A. Moreover, as depicted in FIG. 3, an ink tube 32 and a flexible flat cable 33 are connected to the carriage 23. The ink tube 32 supplies ink of an ink cartridge to the recording head 39. The flexible flat cable 33 electrically connects a control board on which the controller 130 is mounted and the recording head 39.

As depicted in FIG. 3, the carriage 23 is supported by guide rails 43, 44 each provided extending in the left-right direction 9, at positions separated in the front-rear direction 8. The carriage 23 is coupled to a publicly known belt mechanism disposed in the guide rail 44. Note that this belt mechanism is driven by a carriage motor 103 (refer to FIG. 6). In other words, the carriage 23 which is connected to the belt mechanism that makes a circuitous motion due to drive of the carriage motor 103, can make reciprocating movement in the left-right direction 9. The left-right direction 9 is an example of a main scanning direction.

As depicted in FIG. 2, the recording head 39 is mounted in the carriage 23. A plurality of nozzles 40 are formed in a lower surface of the recording head 39. The recording head 39 discharges ink from the nozzle 40 due to a vibrating element such as a piezo element being vibrated. In a process of the carriage 23 moving, the recording head 39 discharges an ink droplet onto the sheet 12 supported by the platen 42. As a result, an image is recorded on the sheet 12.

Moreover, as depicted in FIG. 3, a strip-like encoder strip 38B extending in the left-right direction 9 is disposed on the guide rail 44. The encoder sensor 38A is mounted on a lower surface of the carriage 23 at a position facing the encoder strip 38B. In the process of the carriage 23 moving, the encoder sensor 38A reads the encoder strip 38B to generate a pulse signal and outputs the generated pulse signal to the controller 130. The encoder sensor 38A and the encoder strip 38B configure a carriage sensor 38 (refer to FIG. 6).

[Platen 42]

As depicted in FIG. 2, the platen 42 is disposed between the conveyance roller part 54 and the discharge roller part 55 in the conveyance direction 16. The platen 42 is disposed facing the recording section 24 in the up-down direction 7. The platen 42 supports from below the sheet 12 conveyed by at least one of the conveyance roller part 54 and the discharge roller part 55.

[Maintenance Mechanism 70]

As depicted in FIG. 3, the printer 11 further includes a maintenance mechanism 70. The maintenance mechanism 70 performs maintenance of the recording head 39. In more detail, the maintenance mechanism 70 executes a purge operation that sucks up ink or air in the nozzle 40 and foreign matter adhered to a nozzle surface. Moreover, the ink or air in the nozzle 40 and foreign matter adhered to the nozzle surface will be expressed below as ink, and so on. The ink, and so on, that has been sucked up and removed by the maintenance mechanism 70 is stored in a liquid discharge tank 74 (refer to FIG. 4).

Figure 4:
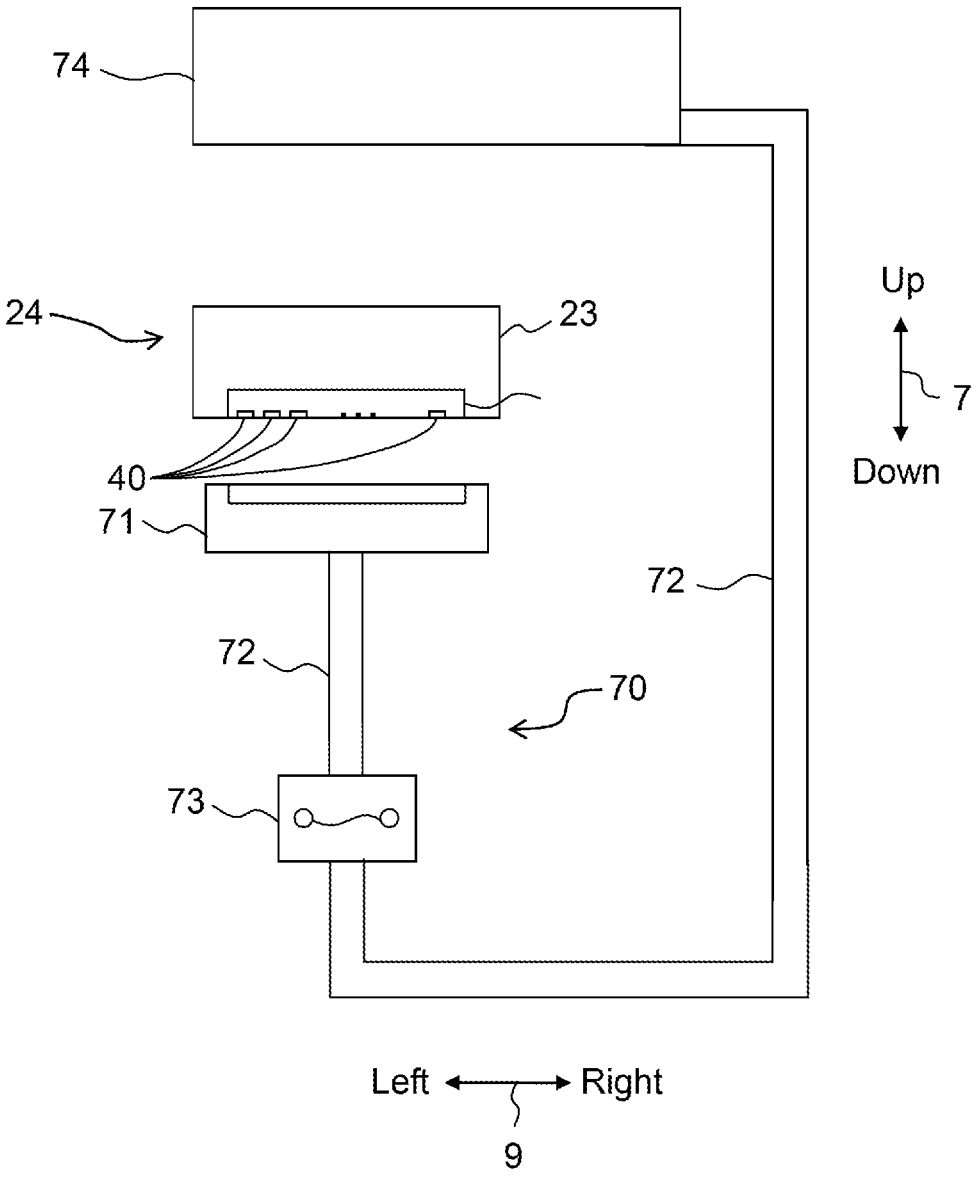
FIG. 4 depicts a schematic configuration diagram of a maintenance mechanism 70.

As depicted in FIG. 3, the maintenance mechanism 70 is disposed in a position displaced to one side (rightward) in the main scanning direction from a sheet facing area. The sheet facing area refers to an area in the main scanning direction where the sheet 12 conveyed by the conveyance section, and the carriage 23, are able to face each other. As depicted in FIG. 4, the maintenance mechanism 70 includes a cap 71, a tube 72, and a pump 73.

The cap 71 is configured by rubber. The cap 71 is disposed at a position that faces the recording head 39 of the carriage 23 when the carriage 23 is positioned at a first position displaced rightward in the main scanning direction from the sheet facing area. The tube 72 reaches from the cap 71 to the liquid discharge tank 74 via the pump 73. The pump 73 is, for example, a rotary type tube pump. The pump 73 is driven by the conveyance motor 102 to suck up the ink, and so on, in the nozzle 40 via the cap 71 and the tube 72 and discharge it to the liquid discharge tank 74 via the tube 72.

The cap 71 is, for example, configured capable of moving between a covering position and a separated position that are separated in the up-down direction 7. The cap 71 in the covering position closely contacts the recording head 39 of the carriage 23 in the first position, thereby covering the nozzle surface. On the other hand, the cap 71 in the separated position is separated from the nozzle surface. The cap 71 moves between the covering position and the separated position by means of a cap shifter 71A (refer to FIG. 6) driven by the feed motor 101. However, a specific configuration for causing the recording head 39 and the cap 71 to contact/separate is not limited to the previously mentioned example.

As another example, the multifunction peripheral 10 may include a raising-and-lowering mechanism (an example of the cap shifter) that moves the guide rails 43, 44 in the up-down direction 7, instead of the cap shifter 71A that moves the cap 71. That is, the carriage 23 in a second position is raised and lowered along with the guide rails 43, 44 that are raised and lowered by the raising-and-lowering mechanism. On the other hand, the cap 71 is fixed in a position facing the recording head 39 of the carriage 23 in the second position. Then, by the guide rails 43, 44 and the carriage 23 being lowered to a certain position by the raising-and-lowering mechanism, the nozzle surface of the recording head 39 is covered by the cap 71. Moreover, by the guide rails 43, 44 and the carriage 23 being raised to a certain position by the raising-and-lowering mechanism, the recording head 39 and the cap 71 separate and the carriage 23 becomes movable in the main scanning direction.

As yet another example, the multifunction peripheral 10 may include both of the raising-and-lowering mechanism that moves the cap 71 and the raising-and-lowering mechanism that moves the guide rails 43, 44. Then, by the carriage 23 and the cap 71 being moved in an orientation causing them to approach each other, the cap 71 may be caused to closely contact the nozzle surface. Furthermore, by the carriage 23 and the cap 71 being moved in an orientation causing them to separate from each other, the cap 71 may be caused to separate from the nozzle surface. That is, the previously mentioned covering position and separated position refer to relative positions of the recording head 39 and the cap 71. Then, all that is required is to change the relative positions of the recording head 39 and the cap 71 by moving one or both of the recording head 39 and the cap 71. In other words, all that is required is to change the relative positions of the recording head 39 and the cap 71 by moving the recording head 39 and the cap 71 relatively.

[Cap Sensor 122]

A cap sensor 122 outputs different detection signals depending on whether the cap 71 is in the covering position or not. The cap sensor 122 outputs a high level signal to the controller 130 based on the cap 71 being in the covering position. On the other hand, the cap sensor 122 outputs a low level signal to the controller 130 based on the cap 71 being in a position different from the covering position. Note that when the cap 71 has been moved from the covering position to the separated position, the detection signal outputted from the cap sensor 122 changes from the high level signal to the low level signal before the cap 71 reaches the separated position.

[Ink Receiving Section 75]

As depicted in FIG. 3, the printer 11 further includes an ink receiving section 75. The ink receiving section 75 is disposed in a position displaced to the other side (leftward) in the main scanning direction from the sheet facing area. In more detail, the ink receiving section 75 is disposed at a position that faces the recording head 39 of the carriage 23 when the carriage 23 is positioned at the second position displaced leftward in the main scanning direction from the sheet facing area. Note that the maintenance mechanism 70 and the ink receiving section 75 may be provided on the same side in the main scanning direction from the sheet facing area. However, the first position and the second position are positions separated in the main scanning direction.

The ink receiving section 75 has roughly a rectangular parallelepiped box shape with an opening formed in its upper surface. An ink absorbing body is housed inside the ink receiving section 75. When the carriage 23 is positioned at the second position, ink discharged toward the opening of the ink receiving section 75 from the nozzle 40 of the recording head 39 is absorbed by the ink absorbing body in the ink receiving section 75.

[Drive Force Transmitting Mechanism 80]

As depicted in FIG. 6, the printer 11 further includes a drive force transmitting mechanism 80. The drive force transmitting mechanism 80 transmits a drive force of the feed motor 101 and the conveyance motor 102 to the feed rollers 25A, 25B, the conveyance roller 60, the discharge roller 62, the cap shifter 71A of the cap 71, and the pump 73. The drive force transmitting mechanism 80 is configured by combining all or some of the likes of a gear wheel, a pulley, an endless annular belt, a planetary gear mechanism (pendulum gear mechanism), and a one-way clutch. Moreover, the drive force transmitting mechanism 80 includes a switching mechanism 170 (refer to FIG. 5) that switches a transmission destination of the drive force of the feed motor 101 and the conveyance motor 102.

[Switching Mechanism 170]

As depicted in FIG. 3, the switching mechanism 170 is disposed in a position displaced to the one side in the main scanning direction from the sheet facing area. Moreover, the switching mechanism 170 is disposed below the guide rail 43. As depicted in FIG. 5, the switching mechanism 170 includes a slide member 171, drive gears 172, 173, driven gears 174, 175, 176, 177, a lever 178, and springs 179, 180 that are examples of a biasing member. The switching mechanism 170 is configured switchable to a first state, a second state, and a third state.

The first state is a state where the drive force of the feed motor 101 is transmitted to the feed roller 25A, but is not transmitted to the feed roller 25B and the cap shifter 71A of the cap 71. The second state is a state where the drive force of the feed motor 101 is transmitted to the feed roller 25B, but is not transmitted to the feed roller 25A and the cap shifter 71A of the cap 71. The third state is a state where the drive force of the feed motor 101 is transmitted to the cap shifter 71A of the cap 71, but is not transmitted to the feed rollers 25A, 25B. Moreover, the first state and the second state are states where the drive force of the conveyance motor 102 is transmitted to the conveyance roller 60 and the discharge roller 62, but is not transmitted to the pump 73. The second state is a state where the drive force of the conveyance motor 102 is transmitted to all of the conveyance roller 60, the discharge roller 62, and the pump 73.

The slide member 171 is a roughly circular column shaped member supported by a support shaft (indicated by broken lines in FIG. 5) extending in the left-right direction 9. Moreover, the slide member 171 is configured to be slidable in the left-right direction 9 along the support shaft. Furthermore, the slide member 171 supports the drive gears 172, 173 in a state of each being independently rotatable, at positions displaced in the left-right direction 9 on an outer surface of the slide member 171. That is, the slide member 171 and the drive gears 172, 173 slide in the left-right direction 9 as one united body.

Figure 5A:
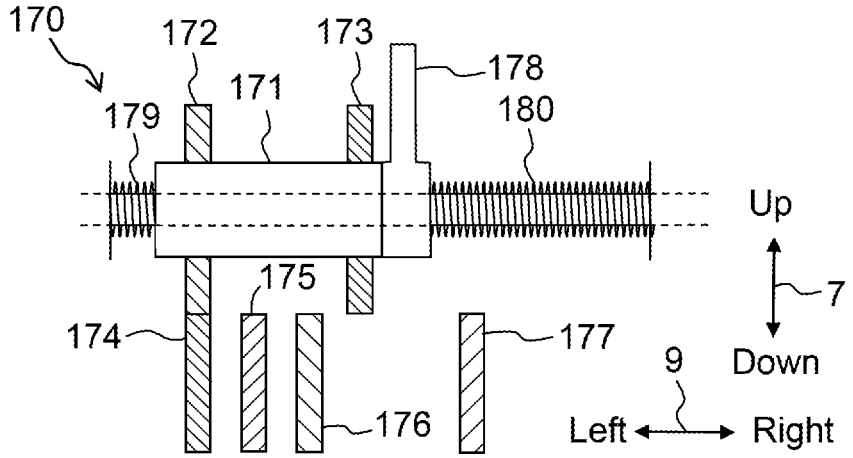
FIGS. 5 A to 5C are schematic configuration diagrams of a switching mechanism 170, FIG. 5A showing a first state, FIG. 5B showing a second state, and FIG. 5C showing a third state.
Figure 5B:
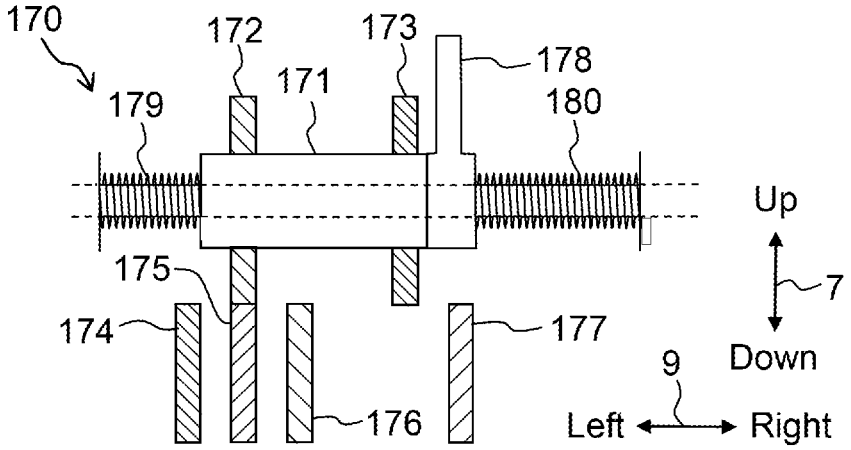
Figure 5C:
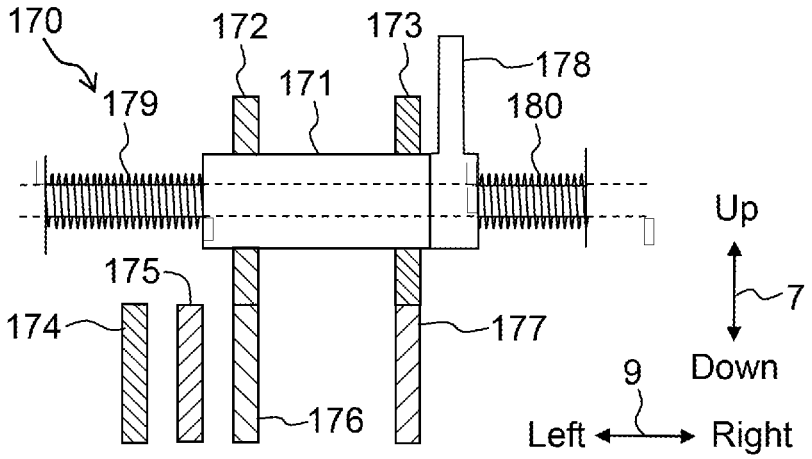

The drive gear 172 rotates by the rotational drive force of the feed motor 101 being transmitted thereto. The drive gear 172 meshes with one of the driven gears 174, 175, 176. In more detail, when the switching mechanism 170 is in the first state, the drive gear 172 meshes with the driven gear 174 as depicted in FIG. 5(A). In addition, when the switching mechanism 170 is in the second state, the drive gear 172 meshes with the driven gear 175 as depicted in FIG. 5(B). Furthermore, when the switching mechanism 170 is in the third state, the drive gear 172 meshes with the driven gear 176 as depicted in FIG. 5(C).

The drive gear 173 rotates by the rotational drive force of the conveyance motor 102 being transmitted thereto. When the switching mechanism 170 is in the first state and the second state, meshing of the drive gear 173 with the driven gear 176 is released as depicted in FIGS. 5(A) and 5(B). Moreover, when the switching mechanism 170 is in the third state, the drive gear 173 meshes with the driven gear 177 as depicted in FIG. 5(C).

The driven gear 174 meshes with a gear train rotating the feed roller 25A. That is, meshing of the drive gear 172 and the driven gear 174 results in the rotational drive force of the feed motor 101 being transmitted to the feed roller 25A. Moreover, release of meshing of the drive gear 172 and the driven gear 174 results in the rotational drive force of the feed motor 101 failing to be transmitted to the feed roller 25A.

The driven gear 175 meshes with a gear train rotating the feed roller 25B. That is, meshing of the drive gear 172 and the driven gear 175 results in the rotational drive force of the feed motor 101 being transmitted to the feed roller 25B. Moreover, release of meshing of the drive gear 172 and the driven gear 175 results in the rotational drive force of the feed motor 101 failing to be transmitted to the feed roller 25B.

The driven gear 176 meshes with a gear train driving the cap shifter 71A of the cap 71. That is, meshing of the drive gear 172 and the driven gear 176 results in the rotational drive force of the feed motor 101 being transmitted to the cap shifter 71A of the cap 71. Moreover, release of meshing of the drive gear 172 and the driven gear 176 results in the rotational drive force of the feed motor 101 failing to be transmitted to the cap shifter 71A of the cap 71.

The driven gear 177 meshes with a gear train driving the pump 73. That is, meshing of the drive gear 173 and the driven gear 177 results in the rotational drive force of the conveyance motor 102 being transmitted to the pump 73. Moreover, release of meshing of the drive gear 173 and the driven gear 177 results in the rotational drive force of the conveyance motor 102 failing to be transmitted to the pump 73. On the other hand, the rotational drive force of the conveyance motor 102 is transmitted to the conveyance roller 60 and the discharge roller 62 without intervention of the switching mechanism 170. That is, the conveyance roller 60 and the discharge roller 62 rotate by the rotational drive force of the conveyance motor 102, regardless of the state of the switching mechanism 170.

The lever 178 is supported by the supporting shaft at a position adjacent on the right to the slide member 171. In addition, the lever 178 slides in the left-right direction 9 along the supporting shaft. Furthermore, the lever 178 projects upwardly. Moreover, a tip of the lever 178 reaches to a position where it can be abutted on by the carriage 23, via an opening 43A provided in the guide rail 43. The lever 178 slides in the left-right direction by being abutted on and moved away from by the carriage 23. Moreover, the switching mechanism 170 includes a plurality of locking sections that lock the lever 178. Moreover, the lever 178 that has been locked in the locking section can stay in its position, even after having been moved away from by the carriage 23.

The springs 179, 180 are supported by the supporting shaft. One end (a left end) of the spring 179 abuts on the frame of the printer 11, and the other end (a right end) of the spring 179 abuts on a left end surface of the slide member 171. That is, the spring 179 biases in a rightward orientation the slide member 171 and the lever 178 abutting on the slide member 171. One end (a right end) of the spring 180 abuts on the frame of the printer 11, and the other end (a left end) of the spring 180 abuts on a right end surface of the lever 178. That is, the spring 180 biases in a leftward orientation the lever 178 and the slide member 171 abutting on the lever 178. Furthermore, a biasing force of the spring 180 is larger than a biasing force of the spring 179.

When the lever 178 is locked in a first locking section, the switching mechanism 170 is in the first state. Moreover, the lever 178 pressed on by the carriage 23 moving in the rightward orientation opposes the biasing force of the spring 180 to move in the rightward orientation and be locked in a second locking section positioned rightward of the first locking section. As a result, the slide member 171 moves in the rightward orientation following movement of the lever 178, due to the biasing force of the spring 179. As a result, the switching mechanism 170 is switched from the first state depicted in FIG. 5 (A) to the second state depicted in FIG. 5 (B). That is, the switching mechanism 170 is switched from the first state to the second state by the lever 178 being abutted on by the carriage 23 heading from the second position to the first position.

In addition, the lever 178 pressed on by the carriage 23 moving to the first position opposes the biasing force of the spring 180 to move in the rightward orientation and be locked in a third locking section positioned even more rightward than the second locking section. As a result, the slide member 171 moves in the rightward orientation following movement of the lever 178, due to the biasing force of the spring 179. As a result, the switching mechanism 170 is switched from the first state depicted in FIG. 5 (A) or the second state depicted in FIG. 5 (B) to the third state depicted in FIG. 5(C). That is, the switching mechanism 170 is switched to the third state by the lever 178 being abutted on by the carriage 23 moving to the first position.

Furthermore, locking in the third locking section, of the lever 178 that has been pressed on by the carriage 23 moving even more rightward than the first position and then moved away from by the carriage 23 moving in the leftward orientation, is released. As a result, the slide member 171 and the lever 178 are moved in the leftward orientation by the biasing force of the spring 180. Then, the lever 178 is locked in the first locking section. As a result, the switching mechanism 170 is switched from the third state depicted in FIG. 5(C) to the first state depicted in FIG. 5(A). That is, the switching mechanism 170 is switched from the third state to the first state by the lever 178 being abutted on and moved away from by the carriage 23 moving from the first position to the second position.

That is, the state of the switching mechanism 170 is switched by abutting/separation of the carriage 23 on/from the lever 178. In other words, the transmission destinations of the drive forces of the feed motor 101 and the conveyance motor 102 are switched by the carriage 23. Note that the state of the switching mechanism 170 according to the present embodiment cannot be switched directly from the third state to the second state, and as previously mentioned, is required to be switched from the third state to the first state and further switched from the first state to the second state.

Moreover, a wall surface 43B most separated from the sheet facing area (that is, demarcating a right side of the opening 43A), of wall surfaces demarcating the opening 43A is an example of a reference wall restricting movement of the carriage 23 in an orientation of increasing separation from the sheet facing area (that is, the rightward orientation). When the carriage 23 moves even further in the rightward orientation than the first position, the lever 178 pressed on by the carriage 23 abuts on the wall surface 43B. As a result, further rightward movement of the carriage 23 is restricted. Hereafter, a position of the carriage 23 when the lever 178 has abutted on the wall surface 43B will be expressed as a "reference position". That is, when the carriage 23 is positioned in the reference position, the lever 178 that has been abutted on by said carriage 23 abuts on the wall surface 43B. In other words, the carriage 23 cannot move rightward of the reference position. The carriage 23 can move between the first position and the reference position in a state where the cap 71 is positioned in the covering position.

Note that a specific example of the reference wall is not limited to the wall surface 43B, provided the reference wall is positioned in a position more separated from the sheet facing area than the cap 71. Note that the reference wall is a wall surface abutted on directly or indirectly by the carriage to restrict movement of the carriage. The reference wall may be provided extending in the up-down direction 7 at right end sections of the guide rails 43, 44, for example. Moreover, the reference wall may abut directly on the carriage 23 positioned in the reference position, thereby restricting the carriage 23 from moving further in the orientation of increasing separation from the sheet facing area than the reference position.

[Power Supply Section 110]

As depicted in FIG. 6, the multifunction peripheral 10 has a power supply section 110. The power supply section 110 supplies each configuring element of the multifunction peripheral 10 with electric power supplied from an external power supply via a power supply plug. In more detail, the power supply section 110 outputs electric power acquired from the external power supply to each of the motors 101 to 103 and the recording head 39 as drive electric power (for example, 24 V), and to the controller 130 as control electric power (for example, 5 V).

Moreover, the power supply section 110 is capable of switching between a drive state and a sleep state, based on a power supply signal outputted from the controller 130. In more detail, the controller 130 switches the power supply section 110 from the sleep state to the drive state by outputting a HIGH level power supply signal (for example, 5 V). Moreover, the controller 130 switches the power supply section 110 from the drive state to the sleep state by outputting a LOW level power supply signal (for example, 0 V).

The drive state is a state where drive electric power is being outputted to the motors 101-103 and the recording head 39. In other words, the drive state is a state where the motors 101-103 and the recording head 39 are operable. The sleep state is a state where drive electric power is not being outputted to the motors 101-103 and the recording head 39. In other words, the sleep state is a state where the motors 101-103 and the recording head 39 are inoperable.

Although illustration of this is omitted, the power supply section 110 outputs control electric power to a controller 30 and a communication part 50, regardless of whether the power supply section 110 is in the drive state or in the sleep state. That is, the controller 30 can execute processing even if the power supply section 110 is in the sleep state. Similarly, the communication part 50 can communicate with an external apparatus even if the power supply section 110 is in the sleep state. However, electric power for a later-mentioned RAM 133 to store information is supplied by the power supply section 110 during the drive state, but is not supplied by the power supply section 110 during the sleep state. That is, the RAM 133 is a volatile memory that can hold information when the power supply section 110 is in the drive state, but cannot hold information when the power supply section 110 is in the sleep state.

[Controller 130]

As depicted in FIG. 6, the controller 130 includes a CPU 131, a ROM 132, the RAM 133, an EEPROM 134, and an ASIC 135, and these are connected by an internal bus 137. The ROM 132 stores the likes of a program for the CPU 131 to control various kinds of operations. The RAM 133 is used as a storage area for temporarily recording the likes of data or a signal employed when the CPU 131 executes the above-described program, or as a work area of data processing. The EEPROM 134 stores setting information that should be held even after a power supply is turned off.

In the present embodiment, the RAM 133 stores position information. Position information is information indicating a current position of the carriage 23, based on the detection signal (that is, the pulse signal) outputted from the carriage sensor 38. The position information indicates a reference value (for example, 100 enc) when the carriage 23 is positioned in the reference position. Moreover, the number of pulse signals outputted from the carriage sensor 38 in a process of the carriage 23 moving leftward are sequentially added to the position information. On the other hand, the number of pulse signals outputted from the carriage sensor 38 in a process of the carriage 23 moving rightward are sequentially subtracted from the position information.

The feed motor 101, the conveyance motor 102, and the carriage motor 103 are connected to the ASIC 135. The ASIC 135 generates a drive signal for rotating each of the motors, and outputs the generated drive signal to each of the motors. Each of the motors is forward rotationally driven or reverse rotationally driven based on the drive signal from the ASIC 135. Moreover, the controller 130 causes ink to be discharged from the nozzle 40 by applying a drive voltage of the power supply section 110 to the vibrating element of the recording head 39.

Moreover, the communication part 50 is connected to the ASIC 135. The communication part 50 is a communication interface capable of communicating with an information processing apparatus 51. That is, the controller 130 outputs various kinds of information to the information processing apparatus 51 via the communication part 50, and receives various kinds of information from the information processing apparatus 51 via the communication part 50. The communication part 50 may transmit and receive a wireless signal by a communication protocol based on Wi-Fi (registered trademark of Wi-Fi Alliance), for example, or may be an interface to which a LAN cable or USB cable is connected. Note that in FIG. 6, the information processing apparatus 51 is surrounded by a dotted line frame, thereby distinguishing it from configuring elements of the multifunction peripheral 10.

Furthermore, the resist sensor 120, the rotary encoder 121, the carriage sensor 38, and the cap sensor 122 are connected to the ASIC 135. The controller 130 detects a position of the sheet 12, based on the detection signal outputted from the resist sensor 120 and the pulse signal outputted from the rotary encoder 121. In addition, the controller 130 detects a position of the carriage 23, based on the pulse signal outputted from the carriage sensor 38. Moreover, the controller 130 detects a position of the cap 71, based on the detection signal outputted from the cap sensor 122.

[Image Recording Process]

Figure 7A:
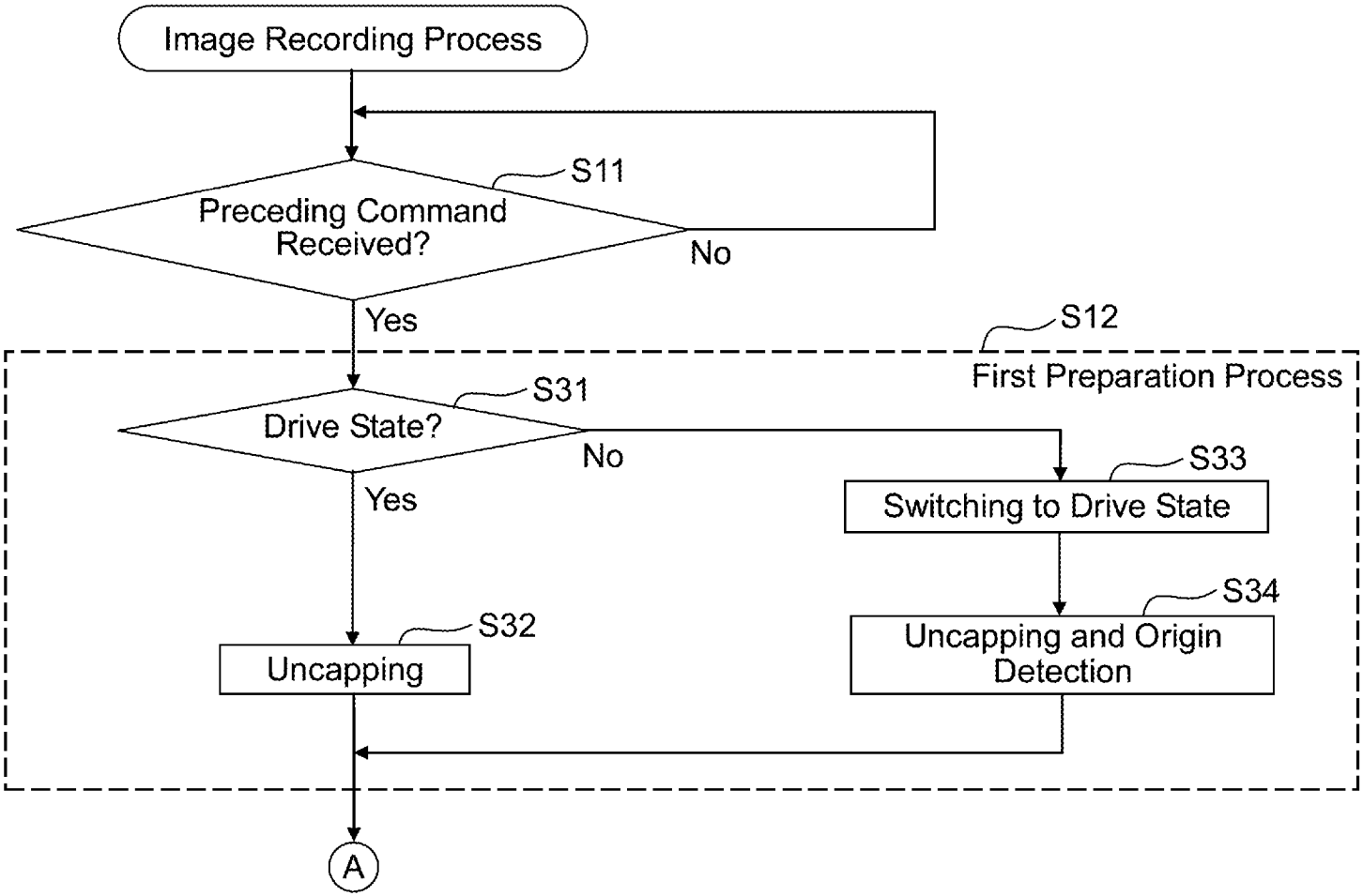
FIGS. 7A and 7B depict a flowchart of an image recording process.
Figure 7B:
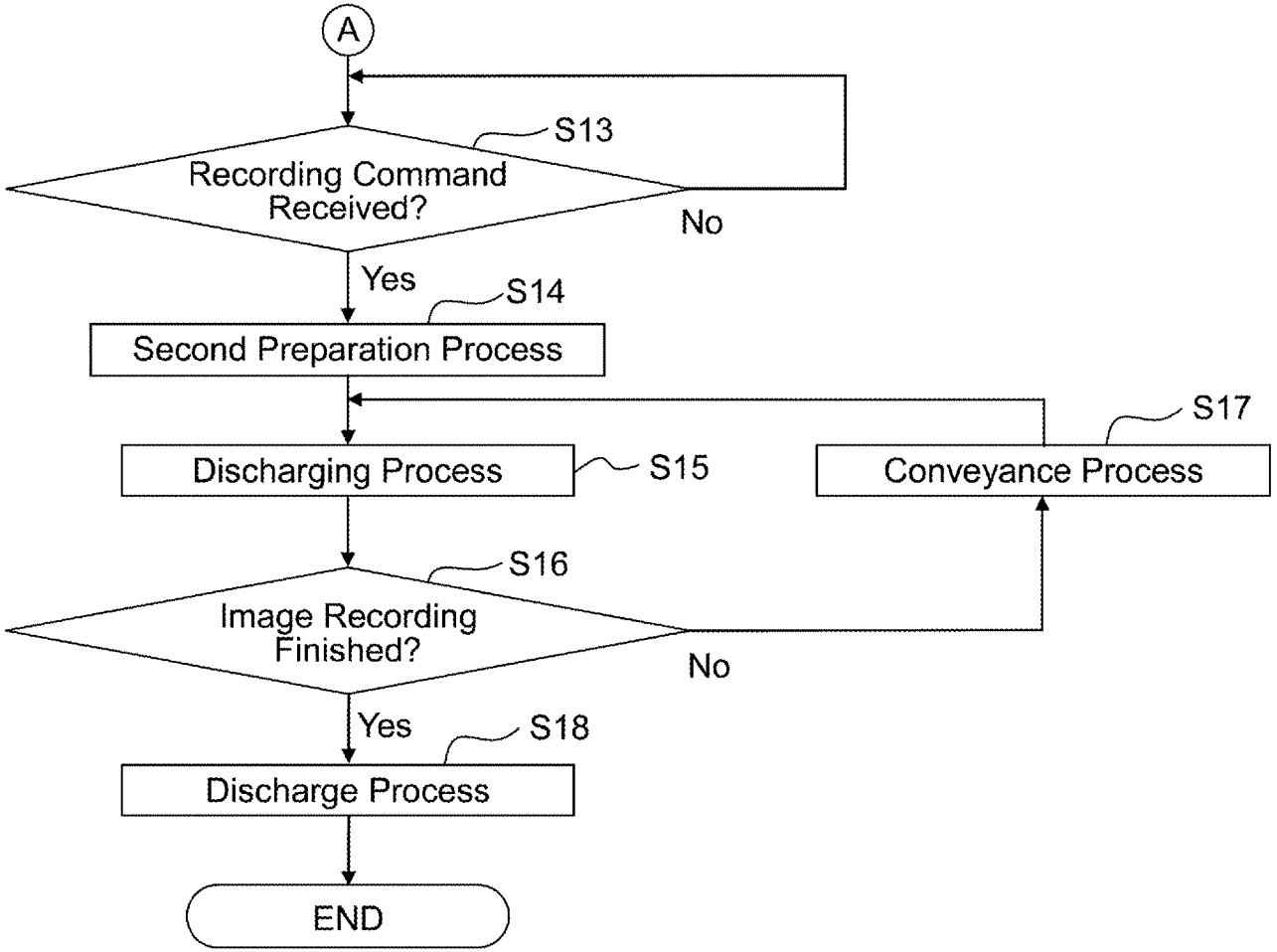

Next, an image recording process of the present embodiment will be described with reference to FIGS. 7 to 9. The multifunction peripheral 10 begins the image recording process based on having received a command from the information processing apparatus 51 via the communication part 50. Note that at a start time point of the image recording process, the carriage 23 is assumed to be positioned in the first position, the cap 71 is assumed to be positioned in the covering position, and the switching mechanism 170 is assumed to be in the third state. Each of the processes below may be executed by the CPU 131 reading the program stored in the ROM 132, or may be achieved by a hardware circuit mounted in the controller 130. Moreover, an execution sequence of each of the processes may be appropriately changed in a range that does not alter the gist of the present teaching.

First, although illustration of this is omitted, the information processing apparatus 51, based on, for example, having received from a user an instruction to make the multifunction peripheral 10 execute the image recording process, transmits a preceding command to the multifunction peripheral 10. The preceding command is a command that gives prior notice of transmission of a later-mentioned recording command. Next, the information processing apparatus 51, based on having transmitted the preceding command, converts to raster data image data designated by the user. Then, the information processing apparatus 51, based on having generated the raster data, transmits the recording command to the multifunction peripheral 10. The recording command is a command to record on the sheet the image indicated by the raster data.

The controller 130, based on having received the preceding command from the information processing apparatus 51 via the communication part 50 (S11: Yes), executes a first preparation process. That is, the preceding command may be expressed in other words as a command that instructs execution of the first preparation process. The first preparation process is a process for putting the printer 11 in a state enabling execution of the recording process. A "state enabling execution of the recording process" may be described in other words as a state enabling an image of not less than a certain quality to be recorded. As depicted in FIG. 8, for example, the first preparation process includes a boosting process (S21), an uncapping process (S22), a first moving process (S23), and a jiggling process (S24, S25).

The boosting process (S21) is a process in which the power supply section 110 boosts to a target voltage $V_T$ a drive voltage supplied to each of configuring elements of the printer 11. The power supply section 110, for example, boosts a power supply voltage supplied from an external power supply, to the target voltage $V_T$, by an unillustrated regulator circuit. Boosting the power supply section 110 refers to, for example, storing electrical energy in an unillustrated storage element such as a condenser. Furthermore, after a charge corresponding to the target voltage $V_T$ has been stored in the storage element, the regulator circuit continues to apply the storage element with a voltage for maintaining the drive voltage.

However, when the drive voltage is suddenly boosted, there is a possibility that the drive voltage during boosting becomes unstable. Accordingly, the controller 130 boosts the drive voltage to a check voltage $V_1$ by, for example, feedback control. Next, the controller 130, based on the drive voltage having reached the check voltage $V_1$, boosts the drive voltage to a check voltage $V_2$ by feedback control. In this way, boosting is performed gradually by repeating a plurality of boosting steps. That is, $V_1 < V_2, \ldots < V_T$. As a result, fluctuation of the power supply voltage during boosting is suppressed.

In addition, the controller 130 may execute the boosting process in a state where the drive voltage has been applied to the recording head 39 by the power supply section 110. A "state where the drive voltage has been applied to the recording head 39" refers to a state where the drive voltage during boosting is applied to the vibrating element of the recording head 39 by setting to a conductive state a switch element of a circuit from the power supply section 110 to the recording head 39. In other words, it may also be expressed as a state where ink is discharged from the nozzle 40 when the drive voltage during boosting has reached the target voltage $V_T$. As a result, fluctuation of the drive voltage during boosting can be further suppressed for the following reason.

First, generally, when a voltage applied to a circuit fluctuates, a rise time and a fall time of a voltage waveform become longer the larger a resistance component in said circuit is. That is, the larger the resistance component is, the smaller a change in voltage per unit time becomes. Moreover, in the circuit from the power supply section 110 to the vibrating element of the recording head 39, there exist resistance components of a transistor configuring the switch element, an output section outputting a drive signal, and so on. Accordingly, if from the power supply section 110 to the recording head 39 is configured as one circuit, then fluctuation of the drive voltage during boosting can be more attenuated compared to when a break is made between the power supply section 110 and the recording head 39 to configure a single body circuit of the power supply section 110.

Moreover, a control circuit of the recording head 39 having the vibrating element can be regarded as a condenser having a certain electrostatic capacity. Moreover, this condenser repeats charging and discharging along with fluctuation of the applied drive voltage. As a result, since a high frequency component of voltage fluctuation can be removed, fluctuation of the drive voltage during boosting can be further attenuated.

Moreover, the boosting process (S21) is typically executed at a timing when power supply of the multifunction peripheral 10 has been activated, or a timing when the power supply section 110 has been switched from the sleep state to the drive state. That is, when the drive voltage supplied by the power supply section 110 has already reached the target voltage $V_T$, the boosting process (S21) is sometimes omitted.

The uncapping process (S22) at least includes a process in which the cap 71 is moved from the covering position to the separated position. Processing content of the uncapping process differs according to a state of the power supply section 110 at a time point when the preceding command was received. Details of the uncapping process will be described with reference to steps S31 to S34 of FIG. 7.

First, the controller 130 judges the state of the power supply section 110 at the time point that the controller 130 has received the preceding command (S31). The case where the power supply section 110 is in the drive state is the case where a return process depicted in FIG. 9 (A) has been executed before the preceding command is received, or the case where a later-mentioned second time has not passed since an immediately preceding recording process has been executed, and so on. On the other hand, the case where the power supply section 110 is in the sleep state is the case where a sleep process depicted in FIG. 9(B) has been executed. The process of step S31 is an example of a judging process.

Moreover, the controller 130, based on having judged that the power supply section 110 is in the drive state (S31: Yes), moves the carriage 23 rightward until the lever 178 abuts on the wall surface 43B (that is, to the reference position), and in this state, rotates the feed motor 101 to an extent of a predetermined rotation amount (S32). The process of step S32 is an example of a first uncapping process. In more detail, the controller 130 subtracts the number of pulse signals outputted from the carriage sensor 38 from the position information stored in the RAM 133, accompanying movement rightward of the carriage 23. Moreover, the controller 130 need only rotate the feed motor 101 based on the position information having reached the reference value.

On the other hand, the controller 130, based on having judged that the power supply section 110 is in the sleep state (S31: No), switches the power supply section 110 from the sleep state to the drive state (S33). That is, the controller 130 outputs the HIGH level power supply signal to the power supply section 110. The process of step S33 is an example of a first switching process. Moreover, the controller 130 moves the carriage 23 rightward until the lever 178 abuts on the wall surface 43B, and in this state, rotates the feed motor 101 to an extent of a predetermined rotation amount, and stores the reference value (100 enc) in the RAM 133 as the position information (S34). Since position information is not stored in the RAM 133 when the carriage 23 is moved in step S34, the controller 130 need only rotate the carriage motor 103 to an extent of a predetermined number of rotations. The process of step S34 is an example of a second uncapping process.

As a result, the rotational drive force of the feed motor 101 is transmitted to the cap shifter 71A via the switching mechanism 170 in the third state, whereby the cap 71 is moved from the covering position to the separated position. In addition, the detection signal outputted from the cap sensor 122 changes from the high level signal to the low level signal before the cap 71 reaches the separated position, in other words, during execution of the uncapping process. Furthermore, whichever of the steps S32, S34 is executed, the reference value is stored in the RAM 133 as the position information.

The first moving process (S23) is a process in which the switching mechanism 170 is switched from the third state to the first state, and a process in which the carriage 23 that has been separated from the cap 71 is moved from the first position to the second position. That is, the controller 130 moves the carriage 23 positioned in the reference position in the uncapping process (S22), in the leftward orientation, until the carriage 23 reaches the second position. As a result, the lever 178 that has been locked in the third locking section is locked in the first locking section. Moreover, in order to suppress a meniscus of the ink formed in the nozzle 40 of the recording head 39 being destroyed, the controller 130 may move the carriage 23 at low speed in the leftward orientation at a start time point of step S23.

The jiggling process (S24, S25) is a process in which at least one of the feed motor 101 and the conveyance motor 102 is forward/reverse rotated in slight amounts. In more detail, the controller 130 forward/reverse rotates both of the feed motor 101 and the conveyance motor 102 when the switching mechanism 170 is in the third state (S24). As a result, surface pressure between the drive gear 172 and the driven gear 176 and surface pressure between the drive gear 173 and the driven gear 177 are released, hence meshing of each of the gears is smoothly released. In addition, the controller 130 forward/reverse rotates the feed motor 101 when the switching mechanism 170 is switched to the first state (S25). As a result, the drive gear 172 and the driven gear 174 can be smoothly meshed. Note that the jiggling process may be only one of steps S24, S25.

Figure 8:
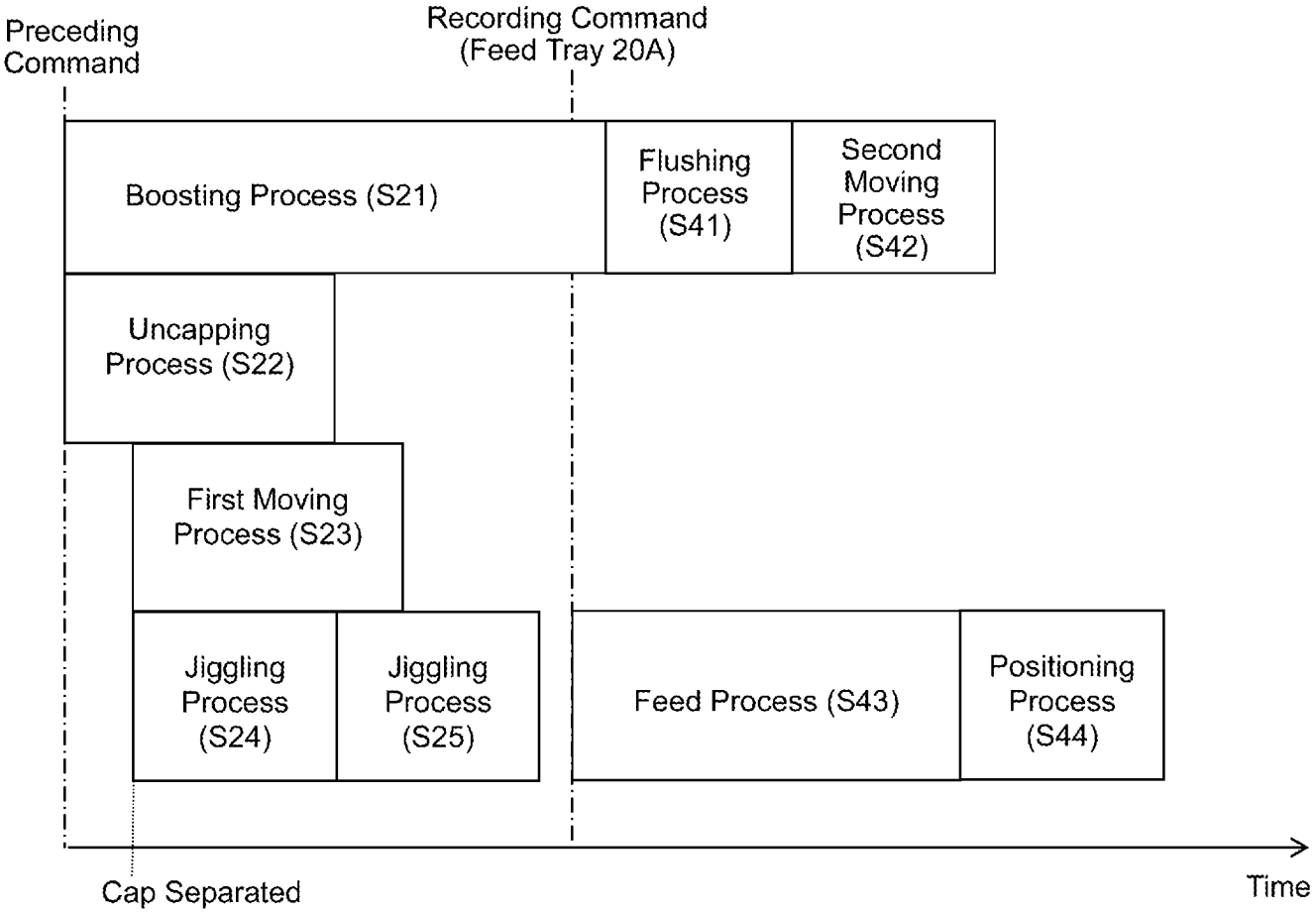
FIG. 8 depicts a timing chart showing execution timings of a first preparation process and a second preparation process.
Figure 9B:
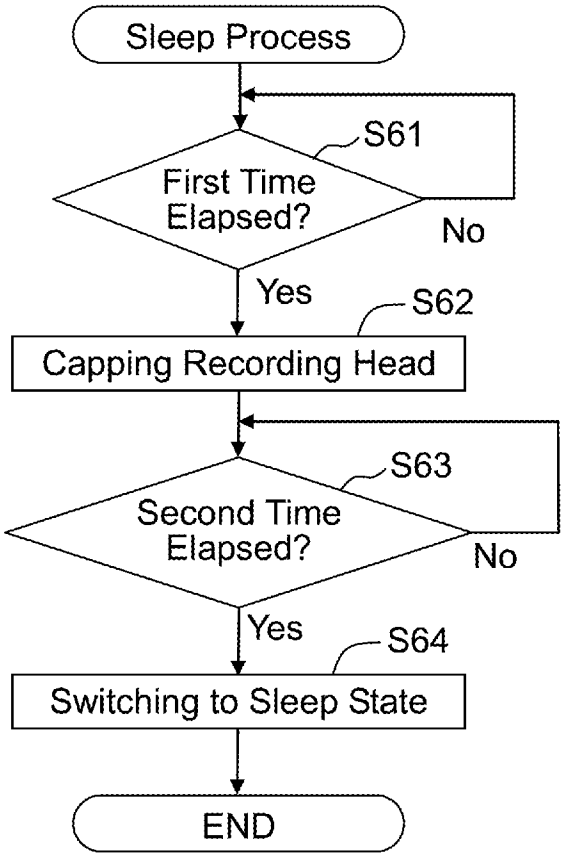
FIG. 9B depicts a flowchart of a sleep process.
Figure 9A:
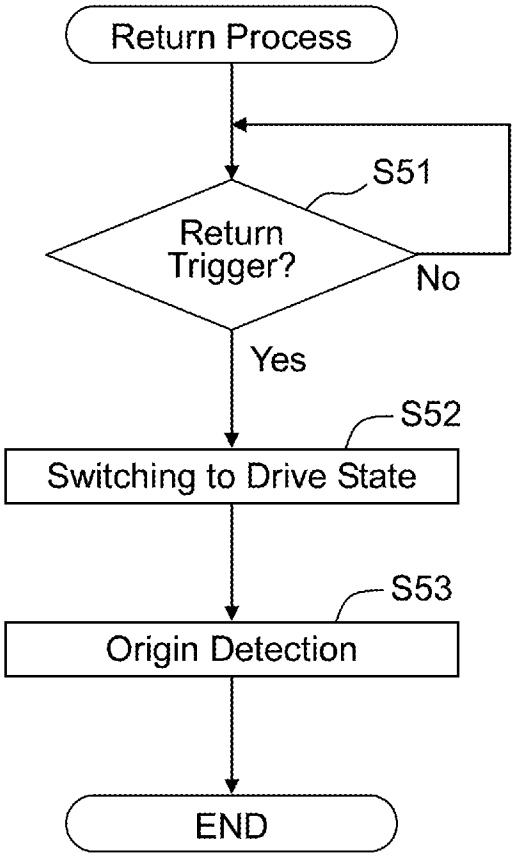
FIG. 9A depicts a flowchart of a return process.

Note that as depicted in FIG. 8, the controller 130 begins the processes of steps S21, S22 simultaneously, at a timing of having received the preceding command. In addition, the controller 130 begins steps S23, S24 simultaneously. However, a start timing of step S24 is not limited to the example of FIG. 8, and step S24 may be started slightly later than step S23. Furthermore, the controller 130 begins the process of step S23 at a timing when the detection signal of the cap sensor 122 has changed from the high level signal to the low level signal. That is, the controller 130 begins step S23 later than a start of steps S21, S22.

Typically, the boosting process has the longest execution time among the plurality of processes (S21 to S25) included in the first preparation process. Accordingly, as depicted in FIG. 8, the controller 130 executes the process of step S21 and each of the processes of steps S22 to S25 in parallel. In other words, the controller 130 executes each of the processes of steps S22 to S25 at certain timings during execution of the process of step S21. Further rephrasing this, each of the processes of steps S22 to S25 are executed in parallel with the process of step S21.

Next, returning to FIG. 7, the controller 130, based on having received the recording command from the information processing apparatus 51 via the communication part 50 (S13: Yes), judges whether the first preparation process has finished or not (S12A). That is, a receiving timing of the recording command is sometimes before finish of the first preparation process, and is sometimes after finish of the first preparation process. The controller 130, based on having judged that the first preparation process has not yet finished (S12A: No), holds execution of subsequent processes until the first preparation process finishes.

Then, the controller 130, based on having judged that the first preparation process has finished (S12A: Yes), executes a second preparation process (S14). The second preparation process is a process not included in the first preparation process, of the process for putting the printer 11 in a state enabling execution of the recording process. As depicted in FIG. 8, for example, the second preparation process includes a flushing process (S41), a second moving process (S42), a feed process (S43), and a cueing process (S44).

The flushing process (S41) is a process in which the recording head 39 is caused to discharge ink toward the ink receiving section 75. That is, the controller 130, by applying the vibrating element with the drive voltage of the power supply section 110 boosted to the target voltage, causes the recording head 39 of the carriage 23 in the second position to discharge ink. Note that an execution time of the flushing process may be set such that the longer an elapsed time since the recording head 39 most recently discharged ink is, the longer an execution time of the flushing process is set.

That is, the controller 130 begins measurement of the elapsed time at a time point when the recording head 39 has discharged ink, and resets the elapsed time at a timing when the recording head 39 has again discharged ink. A trigger of measurement start of the elapsed time may be discharge of ink due to the flushing process (S41), or may be discharge of ink due to a later-mentioned discharging process (S15). In step S14, the controller 130 determines the execution time of the flushing process based on the measured elapsed time. Then, in step S41, the controller 130 causes the recording head 39 discharge ink continuously during the determined execution time.

The second moving process (S42) is a process in which the carriage 23 is moved to a recording start position. That is, the controller 130 moves the carriage 23 from the second position to the recording start position. The recording start position is a position that the carriage 23 begins movement in the main scanning direction in the later-mentioned discharging process. The recording start position is indicated by the received recording command.

The feed process (S43) is a process in which the sheet 12 supported by the feed tray 20A is fed by the feeder 15A to a position where the sheet 12 reaches the conveyance roller part 54. The feed process is executed in the case that the recording command indicates the feed tray 20A as a feed source of the sheet 12. The controller 130 forwardly rotates the feed motor 101, and after the detection signal of the resist sensor 120 changes from the low level signal to the high level signal, further forwardly rotates the feed motor 101 to an extent of a predetermined rotation amount. Then, by the rotational drive force of the feed motor 101 being transmitted to the feed roller 25A via the switching mechanism 170 in the first state, the sheet supported by the feed tray 20A is fed to the conveyance path 65.

The cueing process (S44) is a process in which the sheet 12 that has been brought to the conveyance roller part 54 by the feed process is conveyed in the conveyance direction 16 by the conveyance section to a position where an area on which an image will first be recorded (hereafter, sometimes described as "recording area") can face the recording head 39. An initial recording area on the sheet 12 is indicated in the recording command. The controller 130, by forwardly rotating the conveyance motor 102 to an extent of a certain rotation amount, causes the sheet 12 that has been brought to the conveyance roller part 54 by the feed process to be conveyed by the conveyance section.

Note that each of the processes (S41 to S44) included in the second preparation process cannot be started until after at least some of the plurality of processes included in the first preparation process have finished. The flushing process cannot be started until after the boosting process, the uncapping process, and the first moving process have finished, but can be started even if the jiggling process has not finished. On the other hand, the feed process cannot be started until after the jiggling process has finished, but can be started even if the boosting process and the first moving process have not finished. Moreover, the second moving process cannot be started until after the flushing process has finished. Furthermore, the cueing process cannot be started until after the feed process has finished.

That is, the controller 130, based on having received the recording command and on the boosting process, the uncapping process, and the first moving process having finished, executes the flushing process. Then, the controller 130, based on the flushing process having finished, executes the second moving process. Moreover, the controller 130, based on having received the recording command and on the jiggling process having finished, executes the feed process. Then, the controller 130, based on the feed process having finished, executes the cueing process. On the other hand, the sequentially executed flushing process and second moving process and the feed process can be executed in parallel.

Moreover, although illustration of this is omitted, in the case that the recording command indicates the feed tray 20B as a feed source of the sheet 12, the controller 130 switches the switching mechanism 170 from the first state to the second state, based on the flushing process having finished. That is, the controller 130 moves the carriage 23 which is in motion in the flushing process further in the rightward orientation, whereby the lever 178 locked in the first locking section is locked in the second locking section. Then, the controller 130, based on having switched the switching mechanism 170 to the second state, moves the carriage 23 to the recording start position. Furthermore, the controller 130, based on having switched the switching mechanism 170 to the second state, begins the feed process to feed the sheet 12 supported by the feed tray 20B.

Returning again to FIG. 7, the controller 130, based on all of the processes included in the second preparation process having finished, executes the recording process in accordance with the received recording command (S15 to S18). The recording process includes, for example, the discharging processing (S15) and a conveyance process (S17) that are alternately executed, and a discharge process (S18). The discharging process (S15) is a process in which the recording head 39 is caused to discharge ink onto the recording area of the sheet 12 faced by the recording head 39. The conveyance process (S17) is a process in which the conveyance section is caused to convey the sheet 12 to an extent of a certain conveyance width along the conveyance direction 16. The discharge process (S18) is a process in which the discharge roller part 55 is caused to discharge to the discharge tray 21 the sheet 12 recorded with the image.

That is, the controller 130 moves the carriage 23 from one end to the other end of the sheet facing area and causes the recording head 39 to discharge an ink droplet at a timing indicated by the recording command (S15). Next, the controller 130, based on existence of an image that should be recorded on the next recording area (S16: No), causes the conveyance section to convey the sheet 12 to a position where the next recording area is faced by the recording head 39 (S17). The controller 130 repeatedly executes the processes of steps S15 to S17 until an image is recorded on all of the recording areas (S16: No). Then, the controller 130, based on an image having been recorded on all of the recording areas (S16: Yes), causes the discharge roller part 55 to discharge the sheet 12 to the discharge tray 21 (S18).

Moreover, although illustration of this is omitted, the controller 130, based on having received the recording command but not having received the preceding command, from the information processing apparatus 51 via the communication part 50, executes the processes of step S12 onwards. Moreover, the controller 130 in this case, based on the first preparation process having finished, immediately executes the second preparation process. That is, the processes of steps S31 to S34 are executed even when the recording command has been received without the preceding command having been received.

[Return Process]

Next, details of the return process will be described with reference to FIG. 9 (A). The return process is a process in which the power supply section 110 is switched from the sleep state to the drive state by a trigger (hereafter, described as "return trigger") other than a command received from the information processing apparatus 51. The return trigger is, for example, a button or a touch panel of an operation panel 10A (refer to FIG. 1) having been operated, a cover sensor having detected that a scanner cover 10B (refer to FIG. 1) has been opened to expose a contact glass, a portable storage medium such as a USB memory having been inserted in a memory insertion port 10C (refer to FIG. 1) of the multifunction peripheral 10, and so on.

As an example, the user conceivably operates the operation panel 10A to confirm or change a setting of the multifunction peripheral 10, and then operates the information processing apparatus 51 to transmit the preceding command or the recording command. As another example, the user conceivably opens the scanner cover 10B to place a manuscript on the contact glass and depresses a copy button of the operation panel 10A. As a result, the multifunction peripheral 10 causes a scanner to read an image recorded on the manuscript, and causes the printer 11 to record on the sheet 12 the image indicated by image data generated by the scanner. As yet another example, the user conceivably inserts the USB memory into the memory insertion port 10C of the multifunction peripheral 10 and depresses a direct print button of the operation panel 10A. As a result, the multifunction peripheral 10 causes the printer 11 to record on the sheet 12 an image indicated by image data stored in the USB memory.

First, the controller 130, based on having detected the return trigger when the power supply section 110 is in the sleep state (S51: Yes), switches the power supply section 110 from the sleep state to the drive state (S52). The process of step S52 may be similar to that of step S33. Next, the controller 130 moves the carriage 23 rightward until the lever 178 abuts on the wall surface 43B, and in this state, stores the reference value (100 enc) in the RAM 133 as the position information (S53). Since position information is not stored in the RAM 133 when the carriage 23 is moved in step S53, the controller 130 need only rotate the carriage motor 103 to an extent of a predetermined number of rotations. The process of step S53 is an example of a memory initialization process. On the other hand, the controller 130, based on having detected the return trigger, does not move the cap 71 to the separated position.

[Sleep Process]

Next, details of the sleep process will be described with reference to FIG. 9 (B). The sleep process is a process in which the power supply section 110 is switched from the drive state to the sleep state when the multifunction peripheral 10 does not operate continuously for a certain period. First, the controller 130, based on the recording process (S15 to S18) having finished, begins measurement of the elapsed time. Measurement of the elapsed time is performed using an unillustrated system clock, for example, and is reset based on a command having been received from the information processing apparatus 51 or the return trigger having been detected.

Then, the controller 130, based on the measured elapsed time having reached a first time (S61: Yes), moves the carriage 23 to the first position, changes the switching mechanism 170 to the third state, and moves the cap 71 to the covering position (S62). Note that the controller 130 may further execute the jiggling process along with execution of this process. The process of step S62 is an example of a capping process. Moreover, the controller 130, based on the measured elapsed time having reached a second time (S63: Yes), switches the power supply section 110 from the drive state to the sleep state (S64). That is, the controller 130 outputs the LOW level power supply signal to the power supply section 110. The process of step S64 is an example of a second switching process. As a result, the position information stored in the RAM 133 is erased. Note that the second time the first time. That is, the process of step S64 may be executed at the same timing as step S62, or may be executed later than step S62.

[Technical Effects of Present Embodiment]

Due to the above-described embodiment, in the second uncapping process (S34), a preparation process in which the cap 71 is moved to the separated position and a preparation process in which the position information of the carriage 23 is stored in the RAM 133, are executed in a state of the carriage 23 having been abutted on the wall surface 43B. As a result, a plurality of preparation processes can be executed more efficiently compared to when the process of the carriage 23 being abutted on the wall surface 43B is individually executed in each preparation process. Moreover, since there does not occur a large difference in processing times of the first uncapping process and the second uncapping process, it can be suppressed that FPOT in the case that a command has been received in the sleep state deteriorates more greatly compared to FPOT in the case that a command has been received in the drive state.

Moreover, the processes of steps S31 to S34 are executed not only when the first preparation process is started by the preceding command, but also when the first preparation process is started by the recording command. As a result, deterioration of FPOT can be suppressed not only in the case of the information processing apparatus 51 that has a function of transmitting the preceding command, but also in the case of the recording command being received from a conventional information processing apparatus that does not have a function of transmitting the preceding command.

On the other hand, the return trigger differs from the preceding command or the recording command in that a recording operation is not necessarily executed after the return trigger. As an example, there is a possibility that although the user has operated the operation panel to confirm or change the setting of the multifunction peripheral 10, the user does not cause the information processing apparatus 51 to transmit the preceding command or the recording command. As another example, there is a possibility that although the user has opened the scanner cover, the user does not depress the copy button. As yet another example, there is a possibility that although the user has inserted the USB memory into the multifunction peripheral 10, the user does not depress the direct print button.

Accordingly, it is desirable that as in the above-described embodiment, when the power supply section 110 is switched from the sleep state to the drive state by the return trigger, the memory initialization process only is executed, and the uncapping process is not executed until a command is received from the information processing apparatus 51. Moreover, the controller 130, based on having executed the preceding command or the recording command after the return process, need only execute the first uncapping process. As a result, the cap 71 can be left disposed in the covering position until immediately before the recording head 39 is caused to discharge ink.

Moreover, due to the above-described embodiment, the capping process is executed based on the first time having elapsed after the recording process has finished, and the second switching process is executed based on the second time having elapsed after the recording process has finished. As a result, when the printer 11 is not operated over a long period, drying of ink in the nozzle 40 is suppressed, and power consumption is reduced.

Moreover, due to the above-described embodiment, the first preparation process is executed with the preceding command as a trigger, hence FPOT can be reduced more compared to when the first preparation process is executed after receiving the recording command. Moreover, in the first preparation process, by the uncapping process, the first moving process, and the jiggling process being executed in parallel with the boosting process, the execution time of the first preparation process can be reduced more compared to when each of the processes is executed in sequence.

On the other hand, due to the above-described embodiment, the flushing process is executed after the recording command has been received, hence a standby time from the flushing process having finished to the recording process being started, can be shortened. That is, deterioration of image recording quality due to ink in the nozzle drying, can be suppressed. In this way, by the first preparation process and the second preparation process being executed at an appropriate timing, FPOT can be reduced and deterioration of image recording quality can be suppressed.

What is claimed is:

1. An ink-jet printer, comprising:

a conveyor configured to convey a sheet in a conveyance direction;

a carriage being movable in a main scanning direction along a sheet facing area, the main scanning direction intersecting the conveyance direction, and the sheet facing area facing the sheet conveyed by the conveyor;

a recording head mounted on the carriage to discharge ink from a nozzle;

a sensor detecting a movement amount of the carriage to output a detection signal;

a cap facing the recording head in a case that the carriage is positioned in a first position displaced in the main scanning direction from the sheet facing area, a cap shifter configured to move the cap relative to the recording head, between a covering position closely contacting the recording head to cover the nozzle and a separated position separated from the recording head;

a reference wall restricting movement of the carriage in a direction separating away from the sheet facing area, in a case that the carriage is positioned at a position more separated from the sheet facing area than the first position;

a memory storing position information indicating a position of the carriage based on the detection signal output from the sensor;

a power supply being switchable between a drive state of supplying electric power to the memory and a sleep state of not supplying electric power to the memory;

a command receiver; and a controller configured to control the conveyor, the carriage, the recording head, the sensor, the cap shifter, the memory, and the power supply to execute:

judging a state of the power supply section, under a condition that the command receiver receives a command instructing an operation of the carriage;

in a state where the carriage has been abutted on the reference wall, changing a relative position of the recording head and the cap from the covering position to the separated position to take the cap off the recording head, under a condition that the controller has judged that the state of the power supply is the drive state;

switching the power supply from the sleep state to the drive state, under a condition that the controller has judged that the state of the power supply is the sleep state, taking the cap off the recording head by changing a relative position of the recording head and the cap from the covering position to the separated position, under a condition that the carriage has been abutted on the reference wall;

storing in the memory the position information indicating a position of the carriage that has abutted on the reference wall; and recording an image on the sheet conveyed to the sheet facing area by the conveyor while moving the carriage in the main scanning direction to a position specified by the position information and the detection signal, under a condition that the cap has been taken off based on having judged that the state of the power supply is the drive state or the cap has been taken off based on having judged that the state of the power supply is the sleep state.

2. The ink-jet printer according to claim 1, wherein the controller judges the state of the power supply, under a condition that the command receiver receives the command from an information processing apparatus.

3. The ink-jet printer according to claim 1, wherein the controller judges the state of the power supply, under a condition that the command receiver receives a preceding command giving prior notice of transmission of a recording command which is an instruction to record the image on the sheet, and the controller controls the recording head to record the image on the sheet, under a condition that the command receiver receives the recording command prior notice of which was given by the preceding command.

4. The ink-jet printer according to claim 3, wherein the controller judges the state of the power supply, under a condition that the command receiver receives the recording command without having received the preceding command, and the controller controls the recording head to record the image on the sheet, under a condition that the cap is taken off based on having judged that the state of the power supply is the drive state or the cap is taken off based on having judged that the state of the power supply is the sleep state.

5. The ink-jet printer according to claim 3, wherein the ink-jet printer comprises an ink receiver which faces the recording head and receives ink discharged from the nozzle of the recording head, in a case that the carriage is positioned in a second position which is a position displaced in the main scanning direction from the sheet facing area, the second position being different from the first position, and the controller executes a flushing process causing the recording head to discharge ink toward the ink receiver, before recording the image on the sheet, under a condition that the cap is taken off based on having judged that the state of the power supply is the drive state, or the cap is taken off based on having judged that the state of the power supply is the sleep state, and on having received the recording command.

6. The ink-jet printer according to claim 1, wherein the controller switches the power supply from the sleep state to the drive state, under a condition that the controller detects a trigger to return the power supply to the drive state before having received the command, and the controller controls the memory to store the position information, in a state that the carriage has been abutted on the reference wall.

7. The ink-jet printer according to claim 6, wherein the controller controls the carriage and the cap shifter to hold the relative position of the recording head and the cap in the covering position, until detecting the command.

8. The ink-jet printer according to claim 1, further comprising:

a first motor for driving the carriage; and a second motor for driving the cap shifter and being different from the first motor.

9. The ink-jet printer according to claim 1, further comprising a guide rail extending in the main scanning direction supporting the carriage, wherein the reference wall is provided at one end in the main scanning direction of the guide rail.

10. The ink-jet printer according to claim 1, further comprising:

a guide rail extending in the main scanning direction supporting the carriage, and being provided with an opening; and a lever of which one end projects from the opening and of which other end is provided capable of moving back-and-forth, and which moves back-and-forth by the one end abutting on the carriage, wherein the reference wall is a wall surface of the guide rail demarcating the opening, on which the lever abuts when the lever that has abutted on the carriage has moved back-and-forth.

11. The ink-jet printer according to claim 6, further comprising an operation panel, wherein the trigger is generated in a case that the operation panel has been operated.

12. The ink-jet printer according to claim 6, further comprising a cover which is openable, wherein the trigger is generated when the cover has been opened.

13. The ink-jet printer according to claim 6, further comprising a memory mounting port where an external memory is mounted, wherein the trigger is generated when the external memory has been mounted in the memory mounting port.

14. The ink-jet printer according to claim 1, wherein the controller controls the carriage, the cap shifter and the power supply to executes:

moving the carriage to the first position and changing a relative position of the recording head and the cap from the separated position to the covering position by taking the cap off the recording head, under a condition that an elapsed time from ink last being discharged from the nozzle having reached a threshold value, and switching the power supply from the drive state to the sleep state.

* * * * *